US012745832B2

(12) United States Patent
Haas

(10) Patent No.: US 12,745,832 B2
(45) Date of Patent: Sep. 29, 2026

(54) DRINKING VESSEL WITH INTERCHANGEABLE HANDLES

(71) Applicant: Vinglace LLC, Houston, TX (US)

(72) Inventor: Colton Bryan Haas, Houston, TX (US)

(73) Assignee: Vinglace, LLC, Houston, TX (US)

( * ) Notice: Subject to any disclaimer, the term of this patent is extended or adjusted under 35 U.S.C. 154(b) by 172 days.

(21) Appl. No.: 17/300,333

(22) Filed: Jun. 30, 2023

(65) Prior Publication Data

US 2025/0000245 A1 Jan. 2, 2025

(51) Int. Cl.
*A45F 3/18* (2006.01)
*A45F 5/10* (2006.01)

(52) U.S. Cl.
CPC ..... *A45F 3/18* (2013.01); *A45F 5/10* (2013.01); *A45F 2005/1013* (2013.01)

(58) Field of Classification Search
CPC ..... A45F 3/18; A45F 5/10; A45F 2005/1013
USPC ..... 224/148.7; 248/148.7
See application file for complete search history.

(56) References Cited

U.S. PATENT DOCUMENTS 1,338,480 A * 4/1920 Altenberg ..... A47G 23/0216 220/759
3,028,984 A * 4/1962 Bramming ..... A47J 41/02 215/340
4,456,135 A * 6/1984 Beekes ..... B65D 23/106 215/396
5,282,541 A * 2/1994 Chen ..... A47G 19/2266 220/254.1
D391,448 S * 3/1998 Winer ..... D7/510
5,799,811 A * 9/1998 Bruckner ..... A47J 41/0083 215/396
6,216,909 B1 * 4/2001 Lin ..... A47J 45/066 220/756
6,959,827 B2 * 11/2005 Morano ..... A61J 9/0623 215/396
6,978,908 B2 * 12/2005 Morano ..... A61J 9/0623 215/396
D528,862 S * 9/2006 Li ..... D7/510
D596,458 S * 7/2009 McKinney ..... D7/510
D600,973 S * 9/2009 Lane ..... D7/387
8,371,244 B2 * 2/2013 Krasner ..... A01K 7/00 119/72.5
9,211,040 B2 * 12/2015 Lane ..... A47J 47/02
2002/0084240 A1 * 7/2002 Yu-Hsien ..... B65D 23/104 215/396
2005/0056610 A1 * 3/2005 Randolph ..... A61J 11/045 215/11.4
2005/0084633 A1 4/2005 Baba et al.
2006/0124579 A1 * 6/2006 Nielson ..... B65D 23/104 215/396

(Continued)

OTHER PUBLICATIONS

International Searching Authority; International Search Report and Written Opinion issued for PCT/US2024/036325 dated Sep. 19, 2024; 11 pages.

(Continued)

*Primary Examiner* — Peter N Helvey
(74) *Attorney, Agent, or Firm* — Womble Bond Dickinson (US) LLP

(57) ABSTRACT

A drinking vessel includes an outer vessel, an inner vessel removably received in the outer vessel, and a plurality of different types of beverage handles configured to be selectively coupled to the outer vessel.

20 Claims, 4 Drawing Sheets

(56) References Cited

U.S. PATENT DOCUMENTS

| | | | | |
|---|---|---|---|---|
| 2006/0124580 | A1* | 6/2006 | Zhang | B65D 23/104 215/396 |
| 2007/0221607 | A1* | 9/2007 | Piccioli | B65D 23/106 215/396 |
| 2007/0272651 | A1 | 11/2007 | DiPasquale et al. | |
| 2010/0294764 | A1 | 11/2010 | Kemper et al. | |
| 2012/0018343 | A1* | 1/2012 | Carland | A45F 3/18 220/660 |
| 2013/0043264 | A1* | 2/2013 | Yang | A45C 13/30 220/754 |
| 2014/0166654 | A1* | 6/2014 | Lane | B65D 39/08 220/262 |
| 2019/0307292 | A1 | 10/2019 | Haas | |
| 2022/0371811 | A1* | 11/2022 | Junkins | B65D 47/305 |

OTHER PUBLICATIONS

United States Patent and Trademark Office; Notice of Allowance issued for U.S. Appl. No. 29/923,540; dated Mar. 5, 2025; 12 pages.

* cited by examiner

DRINKING VESSEL WITH INTERCHANGEABLE HANDLES

CROSS-REFERENCE TO RELATED APPLICATIONS

N/A

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
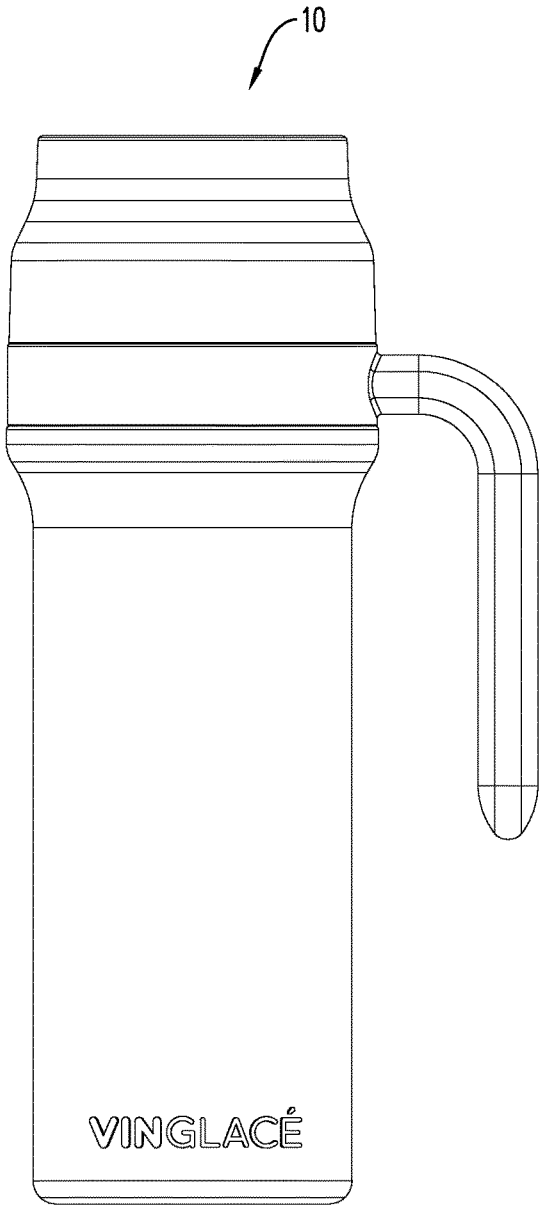
FIG. 1 is front view of a drinking vessel with a first type of beverage handle, according to an embodiment.
Figure 2:
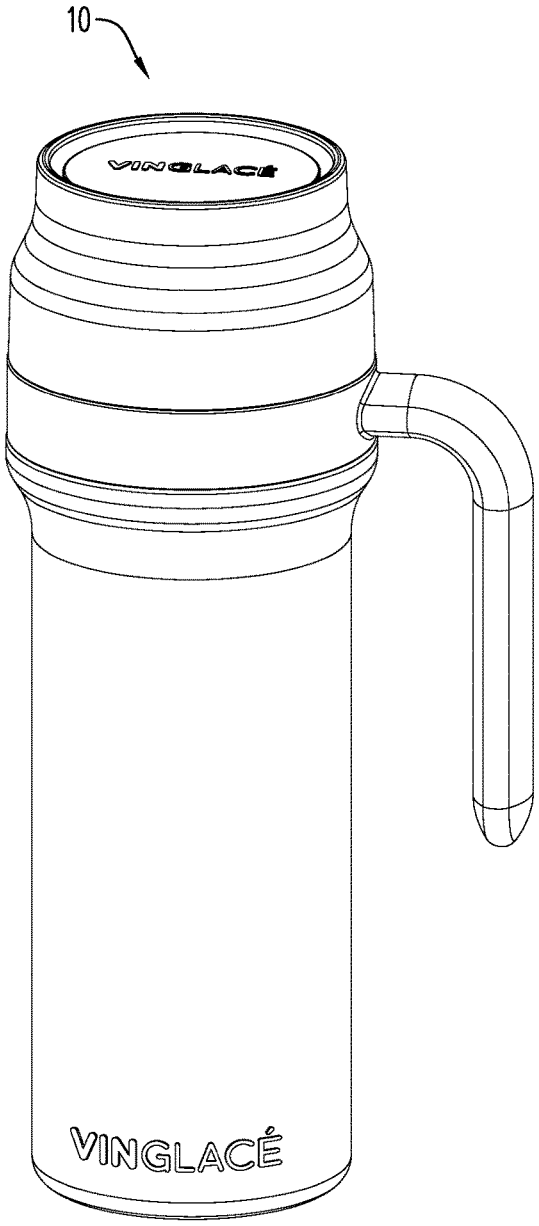
FIG. 2 is a top, perspective view of the drinking vessel of FIG. 1.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DESCRIPTION

Reference will now be made in detail to various exemplary embodiments. Each example is provided by way of explanation and is not meant as a limitation and does not constitute a definition of all possible embodiments.

The term "coupled," as used herein, is defined as directly or indirectly connected. Occurrences of the phrase "in one embodiment," or "in one aspect," herein do not necessarily all refer to the same embodiment or aspect.

At least an embodiment of a drinking vessel (e.g., a water bottle) may be configured for detachably coupling with a plurality of different types of handles. For example, the drinking vessel may include an outer vessel and a plurality of different types of handles, such as, for example, a strap-type handle, a closed-loop type handle, an arm-type handle, or the like, each configured to be selectively coupled to the outer vessel. A user may exchange or replace one particular type of handle with another type of handle depending on their preference. In aspects, each handle may be coupled to a collar that is secured to the drinking vessel between a double-walled outer vessel and a top cap.

For purposes of illustrating features of the embodiments, embodiments of a drinking vessel 10, such as, for example, a water bottle, are introduced and referenced throughout the disclosure. The drinking vessel 10 generally includes an outer vessel 100, an inner vessel 200 (e.g., a container fabricated from glass), a cap 300, and a beverage handle 400. The outer vessel 100 may be a double-walled, vacuum sealed stainless-steel water bottle and has a top end portion 102 defining a first set of screw threads 104*a* and a second set of screw threads 104*b* positioned above the first set of screw threads 104*a*. The first set of screw threads 104*a* is configured to threadedly couple to a collar 402 of the beverage handle 400, and the second set of screw threads 104*b* is configured to threadedly couple to the cap 300. In aspects, the top end portion 102 of the outer vessel 100 may be devoid of threading such that the beverage handle 400 and the cap 300 may be detachably secured to the outer vessel 100 via another suitable fastening engagement, such as, for example, friction-fit engagement. The outer vessel 100 may include a shoulder 106 or stop protruding radially outward therefrom on which the collar 402 of the beverage handle 400 sits. The outer vessel 100 may be formed from plastic, metal, and various other suitable materials that may house and retain beverages. According to an aspect, the outer vessel 100 may be formed of a thermally insulating material.

Figure 3:
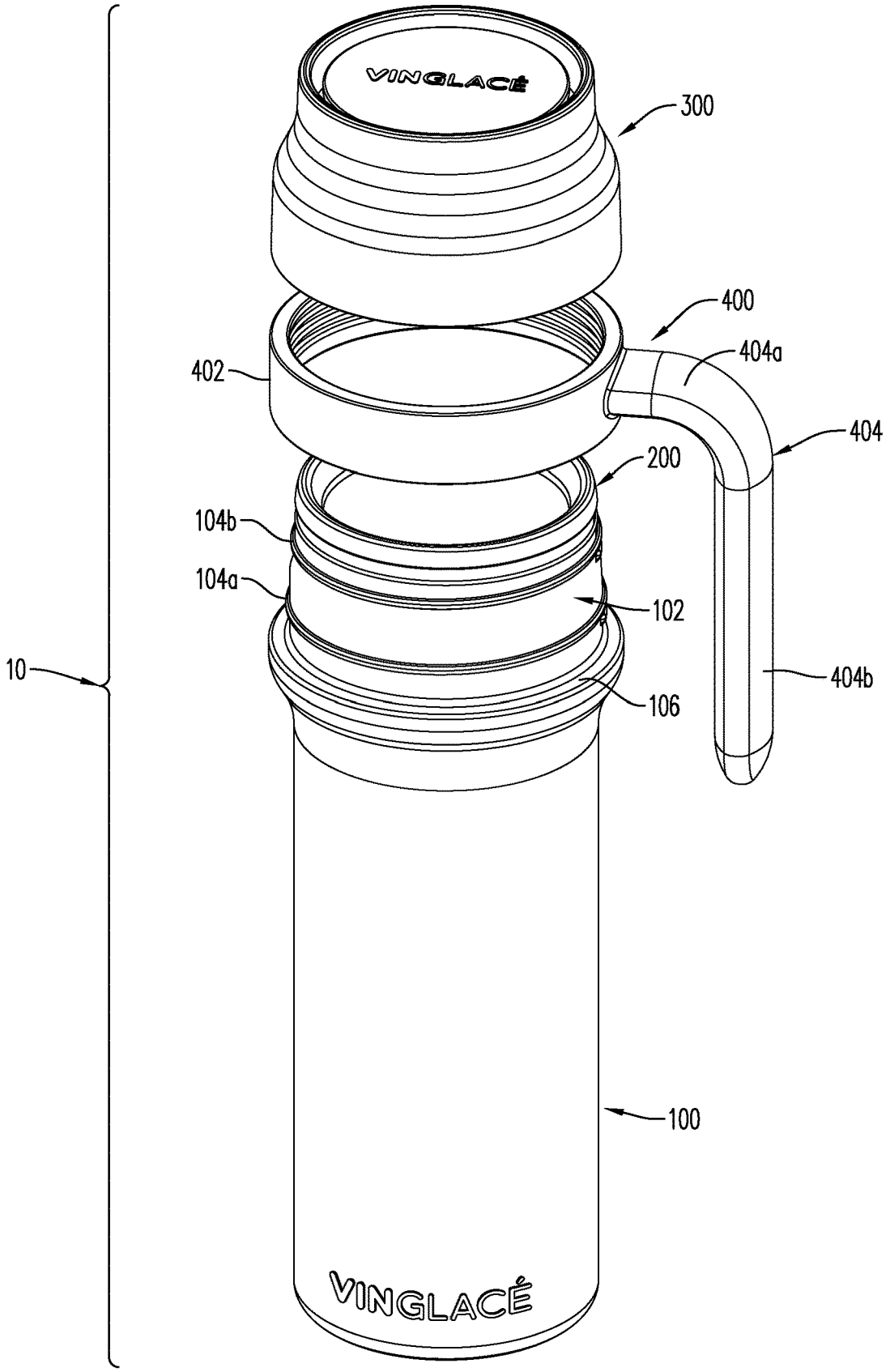
FIG. 3 is a top, perspective view of the drinking vessel of FIG. 1, illustrating the drinking vessel in a disassembled configuration.

The inner vessel 200 (FIG. 3) is provided concentrically within the outer vessel 100 and may be removable from the outer vessel 100. According to an aspect, the inner vessel 200 may be formed from a variety of suitable materials, such as metals, plastics and any other suitable materials for housing beverage items. According to an aspect, the inner vessel 200 is formed of glass. The inner vessel 200 has a sipping portion configured to sit on or overlap with a top edge of the top end portion 102 of the outer vessel 100. The sipping portion protrudes upwardly from the top end portion 102.

The beverage handle 400 of the drinking vessel 10 generally includes the collar 402 and a handle body 404 coupled to or extending from the collar 402. The collar 402 may have a ring-shape and defines a screw thread on an inner surface thereof configured for threaded engagement with the first set of screw threads 104*a* of the outer vessel 100. The handle body 404 may be a rigid handle having a first body portion 404*a* extending radially outward from the collar 402, and a second body portion 404*b* that is longer than the first body portion 404*a* and which extends perpendicularly downward from the first body portion 404*a*. As such, the handle body 404 may assume an L-shape. The handle body 404 is fixedly secured to the collar 402 such that the collar 402 and handle body 404 may be attached to and detached from the outer vessel 100 as an integral unit. In another aspect of the present disclosure, the collar 402 may be configured to detachably couple to a plurality of different types of handle bodies such that the handle body 404 may be replaced with another type of handle body while the collar 402 remains attached to the outer vessel 100.

The cap 300 is configured to detachably couple to the top end portion 104 (FIG. 3) of the outer vessel 100 such that the collar 402 is positioned axially between the cap 300 and the shoulder 106 of the outer vessel 100 when the drinking vessel 10 is fully assembled. In aspects, the cap 300 may be coupled to the outer vessel 100 without having the beverage handle 400 also attached to the outer vessel 100.

Figures 4A, 4B, 4C:
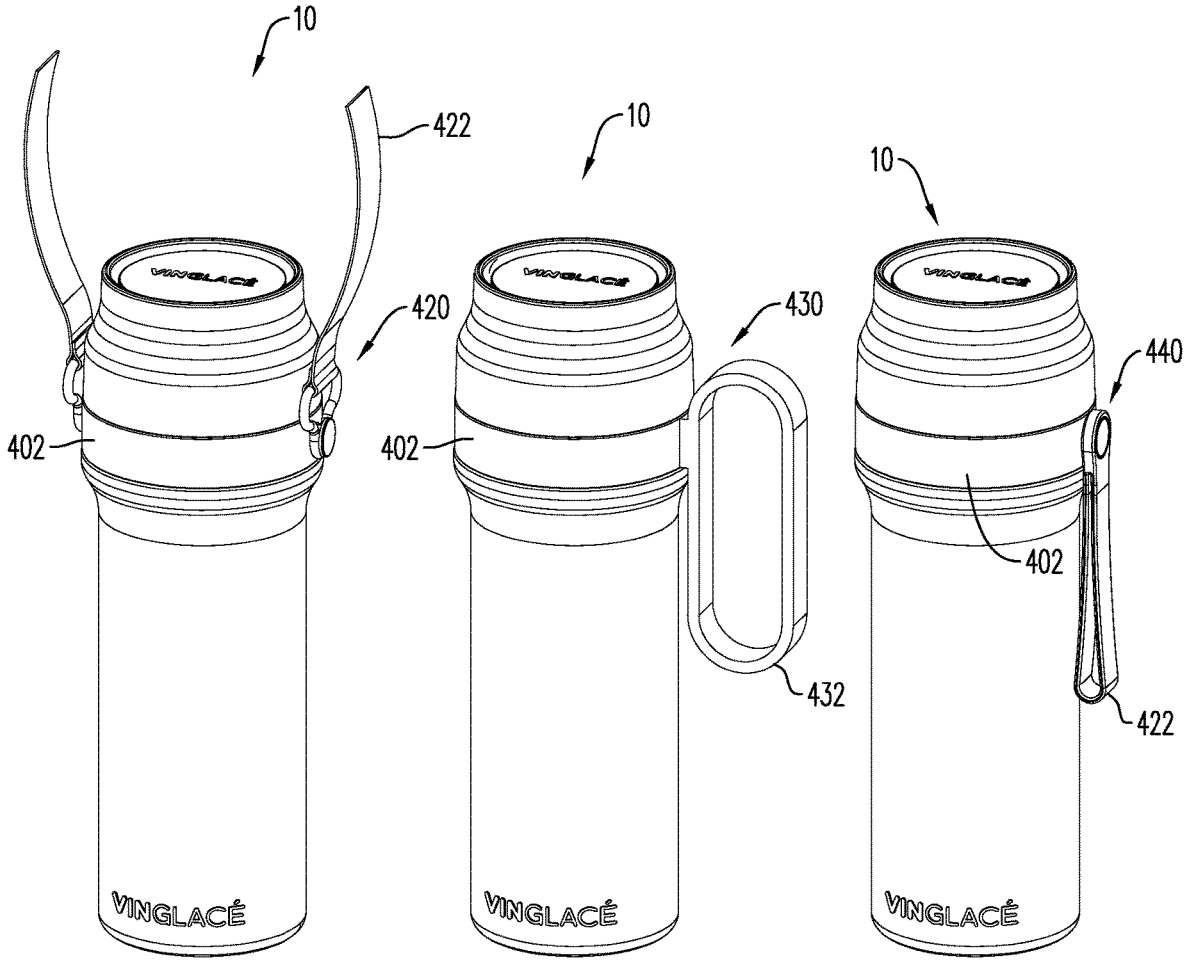
FIG. 4A is a top, perspective view illustrating the drinking vessel of FIG. 1 with a second type of beverage handle.
FIG. 4B is a top, perspective view illustrating the drinking vessel of FIG. 1 with a third type of beverage handle.
FIG. 4C is a top, perspective view illustrating the drinking vessel of FIG. 1 with a fourth type of beverage handle.

As shown in FIGS. 4A-4C, the drinking vessel 10 further includes a plurality of different types of beverage handles 420, 430, 440 configured to be interchangeable with the beverage handle 400. Each of the different types of beverage handles 420, 430, 440 includes the collar 402 and a different or discrete type of handle body 422, 432, 442 fixedly secured to or detachably secured to the collar 402. The handle body 422 of FIG. 4A includes a strap having free ends attached to diametrically opposed sides of the collar 402. The handle body 432 of FIG. 4B is a closed loop handle attached to the collar 402. The handle body 442 of FIG. 4C is a closed loop strap having two ends that are both coupled to the same side of the collar 402. It is contemplated that other types and configurations of handle bodies may be coupled to the outer vessel 100 of the drinking vessel 10.

Figure 5:
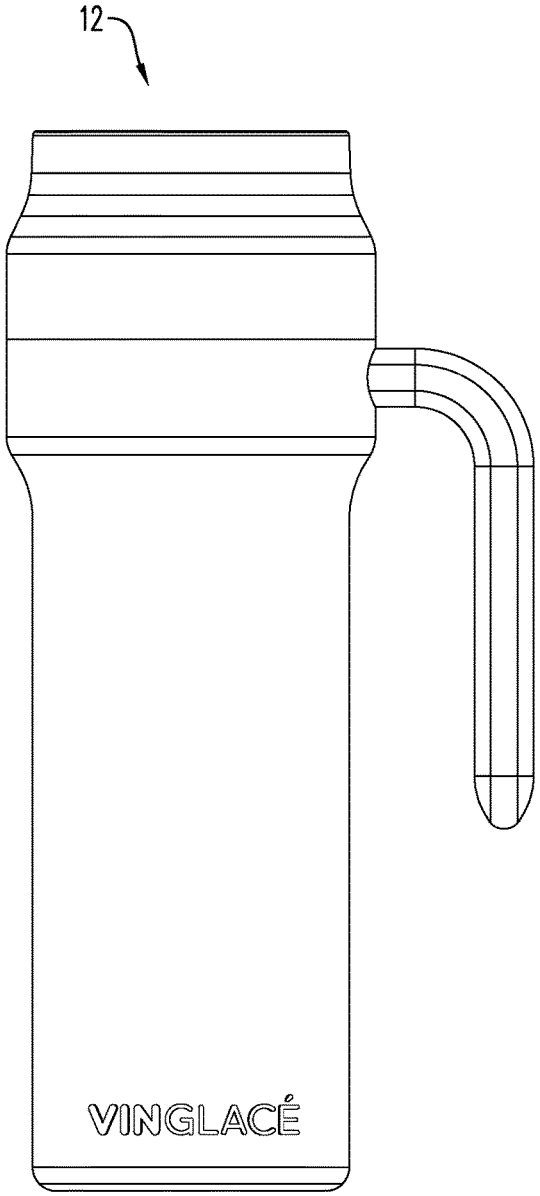
FIG. 5 is a front view illustrating a drinking vessel according to an embodiment.
Figure 6:
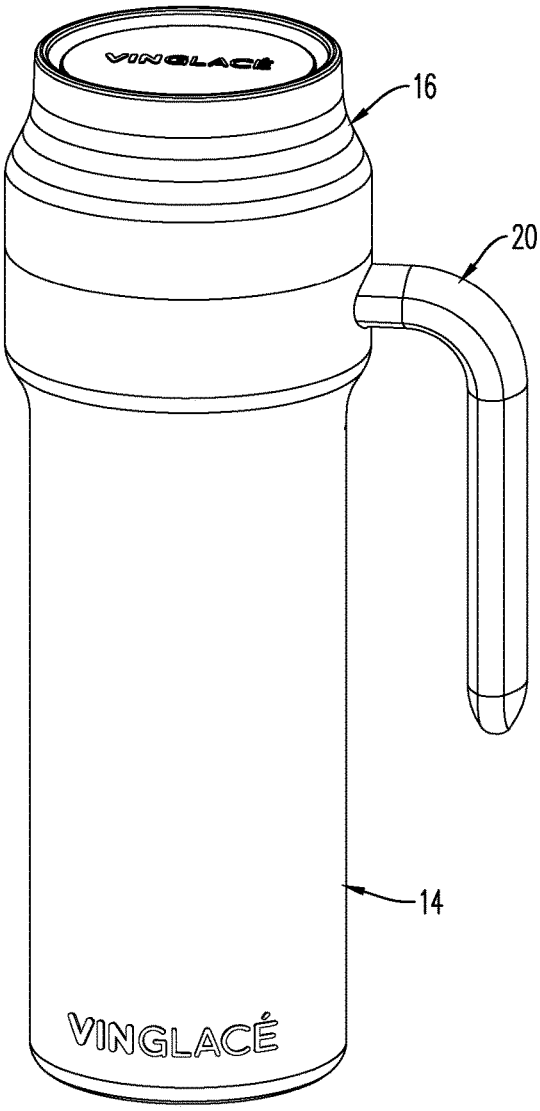
FIG. 6 is a top, perspective view illustrating the drinking vessel of FIG. 5.

As shown in FIGS. 5 and 6, another embodiment of a drinking vessel 12 is provided that generally includes an outer vessel 14, an inner vessel (not shown) similar to the inner vessel 200, a cap 16, and a handle body 20 permanently affixed to and extending from the outer vessel 14.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A drinking vessel, comprising:

an outer vessel including a top end portion, the outer vessel comprising a double-walled vessel;

an inner vessel configured for receipt in the outer vessel through the top end portion; and a plurality of different types of beverage handles configured to be selectively coupled to the top end portion of the outer vessel, wherein each beverage handle of the plurality of different types of beverage handles includes:

a collar configured to be received over the top end portion of the outer vessel and directly and selectively coupled to and uncoupled from the top end portion of the outer vessel, wherein, when the collar is coupled to the top end portion of the outer vessel, at least a portion of the top end portion extends above the collar; and a handle body coupled to the collar.

2. The drinking vessel according to claim 1, further comprising a cap detachably coupled to the outer vessel.

3. The drinking vessel according to claim 2, wherein the outer vessel includes a shoulder extending radially outward therefrom, the collar being positioned axially between the cap and the shoulder.

4. The drinking vessel according to claim 1, wherein the handle body includes at least one of:

a rigid, L-shaped handle body;

a closed-loop handle body; or a strap.

5. The drinking vessel according to claim 1, wherein the inner vessel is fabricated from glass.

6. A drinking vessel, comprising:

an outer vessel comprising a double-walled vessel and having a top end portion defining a first screw thread on an outer surface of the outer vessel;

an inner vessel configured for receipt in the outer vessel;

a beverage handle including:

a collar comprising a second screw thread on an inner surface of the collar, the collar configured to be received over the top end portion of the outer vessel and the second screw thread configured to be selectively, threadedly coupled to the first screw thread of the outer vessel with at least a portion of the top end portion extending above the collar; and a handle body coupled to the collar.

7. A method of exchanging a first type of beverage handle with a second type of beverage handle, the method comprising:

rotating a collar of the first type of beverage handle in a first direction relative to a top end portion of an outer vessel, the outer vessel comprising a double-walled vessel, an outer surface of the top end portion of the outer vessel comprising a first screw thread, the collar of the first type of beverage handle comprising a first screw thread on an inner surface of the collar, and the collar rotated to threadedly uncouple the collar of the first type of beverage handle from the first screw thread of the top end portion of the outer vessel;

placing a collar of a second type of beverage handle over the top end portion of the outer vessel, the collar of the second type of beverage handle including a third screw thread;

rotating the collar of the second type of beverage handle in a second direction relative to the top end portion of the outer vessel to threadedly couple the collar of the second type of beverage handle to the first screw thread of the top end portion of the outer vessel, wherein at least a portion of the top end portion of the outer vessel extends above the collar of the second type of beverage handle when the collar of the second type of beverage handle is threadedly coupled to the top end portion of the outer vessel; and coupling a cap to the top end portion of the outer vessel such that the collar of the second type of beverage handle is positioned axially between a shoulder of the outer vessel and the cap.

8. The drinking vessel of claim 1, wherein the collar is configured to be coupled around the top end portion of the outer vessel.

9. The drinking vessel of claim 1, wherein a concentric portion of the inner vessel is surrounded by the outer vessel and the collar when the inner vessel is received in the outer vessel.

10. The drinking vessel of claim 1, wherein the collar includes a ring-shape.

11. The drinking vessel of claim 1, wherein the collar defines a screw thread on an inner surface configured to engage a set of screw threads on the top end portion.

12. The drinking vessel of claim 1, wherein the top end portion of the outer vessel includes a first set of screw threads and a second set of screw threads, the first set of screw threads configured to couple with the collar, and the second set of screw threads configured to couple with a cap.

13. The drinking vessel of claim 1, wherein the inner vessel includes a sipping portion configured to sit on or overlap with a top edge of the top end portion of the outer vessel.

14. The drinking vessel of claim 13, wherein the sipping portion protrudes upwardly from the top end portion of the outer vessel.

15. The drinking vessel of claim 1, wherein the collar and the handle body are an integral unit.

16. The drinking vessel of claim 1, wherein the outer vessel includes a shoulder protruding radially outward and configured to axially align with the collar.

17. The drinking vessel of claim 1, further comprising a cap configured to couple to the top end portion of the outer vessel.

18. The drinking vessel of claim 17, wherein the cap is axially aligned with the collar when the cap and the collar are coupled to the top end portion of the outer vessel.

19. The drinking vessel of claim 18, wherein a first concentric portion of the inner vessel is surrounded by the cap and the outer vessel when the inner vessel is received in the outer vessel.

20. The drinking vessel of claim 19, wherein a second concentric portion of the inner vessel, separate from the first concentric portion of the inner vessel, is surrounded by the collar and the outer vessel when the inner vessel is received in the outer vessel.

* * * * *